US008574079B2

(12) United States Patent
Russell

(10) Patent No.: US 8,574,079 B2
(45) Date of Patent: Nov. 5, 2013

(54) WIRELESS WAGERING SYSTEM

(75) Inventor: Patrick Gene Russell, Riverview (CA)

(73) Assignee: Spielo International Canada, ULC, Moncton, New Brunswick (CA)

( * ) Notice: Subject to any disclaimer, the term of this patent is extended or adjusted under 35 U.S.C. 154(b) by 1118 days.

(21) Appl. No.: 12/270,483

(22) Filed: Nov. 13, 2008

(65) Prior Publication Data

US 2009/0163277 A1 Jun. 25, 2009

Related U.S. Application Data

(60) Provisional application No. 61/003,031, filed on Nov. 13, 2007.

(51) Int. Cl.
*A63F 9/24* (2006.01)

(52) U.S. Cl.
USPC ..... 463/39; 463/25; 463/37

(58) Field of Classification Search
USPC ..... 463/20, 36–37, 39, 25, 29; 200/310; 320/108; 342/734; 345/158, 168; 361/683; 455/522, 572–573
See application file for complete search history.

(56) References Cited

U.S. PATENT DOCUMENTS

| | | | | |
|---|---|---|---|---|
| 4,017,081 | A * | 4/1977 | Windisch | 463/22 |
| 4,403,777 | A * | 9/1983 | Del Principe et al. | 463/1 |
| 5,052,649 | A * | 10/1991 | Hunnicutt | 248/311.2 |
| 5,069,453 | A | 12/1991 | Koza et al. | |
| 5,101,406 | A | 3/1992 | Messenger | |
| 5,112,050 | A | 5/1992 | Koza et al. | |
| D363,956 | S * | 11/1995 | Mathews | D21/385 |
| 5,685,776 | A * | 11/1997 | Stambolic et al. | 463/46 |
| 5,854,621 | A * | 12/1998 | Junod et al. | 345/158 |
| 6,049,725 | A * | 4/2000 | Emmert et al. | 455/573 |
| 6,210,267 | B1 * | 4/2001 | Long et al. | 454/189 |
| 6,229,229 | B1 * | 5/2001 | Sharp | 307/118 |
| 6,270,410 | B1 * | 8/2001 | DeMar et al. | 463/20 |
| 6,400,272 | B1 | 6/2002 | Holtzman et al. | |
| 6,633,986 | B1 * | 10/2003 | Sellers | 713/300 |
| 6,638,166 | B2 * | 10/2003 | Hedrick et al. | 463/20 |
| 6,682,421 | B1 * | 1/2004 | Rowe et al. | 463/25 |

(Continued)

FOREIGN PATENT DOCUMENTS

| | | |
|---|---|---|
| EP | 1559460 A1 | 8/2005 |
| EP | 1804531 A1 | 7/2007 |

(Continued)

OTHER PUBLICATIONS

Catalog—Xbox 360 Play and Charge Kit (xbox.com), http://web.archive.org/web/2007014202759/http://xbox.com/en-CA/hardwar/x/xbox360playchargekit, Jan. 4, 2007.

*Primary Examiner* — Dmitry Suhol
*Assistant Examiner* — Jason Yen
(74) *Attorney, Agent, or Firm* — Sullivan & Worcester LLP; Christopher T. McWhinney

(57) ABSTRACT

A wireless wagering system includes a wireless game control and a video wagering terminal. The wireless game control can include a button configured to receive game-play input from a game player, a battery configured to supply power to the wireless game control, and a first transceiver configured to transmit a master data packet from the wireless game control to a video wagering terminal, wherein the master data packet has a payload which includes information related to a voltage and a charging status of the battery.

21 Claims, 9 Drawing Sheets

(56) References Cited

U.S. PATENT DOCUMENTS

| | | | | |
|---|---|---|---|---|
| 6,702,672 | B1 * | 3/2004 | Angell et al. | 463/25 |
| 6,779,794 | B2 * | 8/2004 | Hedrick et al. | 273/148 R |
| 6,846,238 | B2 * | 1/2005 | Wells | 463/39 |
| 6,992,462 | B1 | 1/2006 | Hussaini et al. | |
| 7,017,805 | B2 | 3/2006 | Meehan | |
| 7,069,044 | B2 * | 6/2006 | Okada et al. | 455/556.1 |
| 7,217,191 | B2 * | 5/2007 | Cordell | 463/37 |
| 7,437,671 | B2 * | 10/2008 | Lapstun et al. | 715/702 |
| 7,641,358 | B1 * | 1/2010 | Smith et al. | 362/183 |
| 7,699,703 | B2 * | 4/2010 | Muir et al. | 463/29 |
| 7,775,884 | B1 * | 8/2010 | McCauley | 463/39 |
| 7,883,417 | B2 * | 2/2011 | Bruzzese et al. | 463/39 |
| 7,918,728 | B2 * | 4/2011 | Nguyen et al. | 463/29 |
| 2002/0005707 | A1 * | 1/2002 | Kerai et al. | 320/106 |
| 2002/0032055 | A1 * | 3/2002 | Church et al. | 463/40 |
| 2002/0049088 | A1 * | 4/2002 | Fields | 463/43 |
| 2002/0123381 | A1 * | 9/2002 | Akeripa | 463/36 |
| 2003/0054887 | A1 * | 3/2003 | Dettrey et al. | 463/42 |
| 2003/0064805 | A1 | 4/2003 | Wells | |
| 2004/0017110 | A1 * | 1/2004 | Yim | 307/23 |
| 2004/0082385 | A1 | 4/2004 | Silva et al. | |
| 2004/0118669 | A1 * | 6/2004 | Mou | 200/310 |
| 2004/0137983 | A1 * | 7/2004 | Kerr et al. | 463/29 |
| 2004/0137987 | A1 * | 7/2004 | Nguyen et al. | 463/42 |
| 2004/0152522 | A1 * | 8/2004 | Gerding | 463/46 |
| 2004/0183674 | A1 | 9/2004 | Ruvarac | |
| 2004/0224768 | A1 * | 11/2004 | Hussaini et al. | 463/37 |
| 2005/0070358 | A1 | 3/2005 | Angell et al. | |
| 2005/0085302 | A1 * | 4/2005 | Nicastro et al. | 463/46 |
| 2005/0143149 | A1 * | 6/2005 | Becker et al. | 455/575.1 |
| 2005/0250446 | A1 * | 11/2005 | Ishikawa et al. | 455/41.2 |
| 2005/0278880 | A1 * | 12/2005 | Pieroni et al. | 15/97.1 |
| 2006/0076934 | A1 | 4/2006 | Ogata et al. | |
| 2006/0113978 | A1 * | 6/2006 | Suzuki | 323/282 |
| 2006/0202660 | A1 * | 9/2006 | Chang | 320/115 |
| 2006/0250351 | A1 * | 11/2006 | Fu | 345/156 |
| 2006/0250764 | A1 * | 11/2006 | Howarth et al. | 361/683 |
| 2006/0273888 | A1 * | 12/2006 | Yamamoto | 340/426.36 |
| 2006/0279039 | A1 * | 12/2006 | Krieger et al. | 273/148 B |
| 2006/0290320 | A1 * | 12/2006 | Kim | 320/114 |
| 2007/0004466 | A1 * | 1/2007 | Haartsen | 455/572 |
| 2007/0035917 | A1 * | 2/2007 | Hotelling et al. | 361/683 |
| 2007/0060358 | A1 * | 3/2007 | Amaitis et al. | 463/42 |
| 2007/0155489 | A1 * | 7/2007 | Beckley et al. | 463/29 |
| 2007/0202950 | A1 * | 8/2007 | Hussaini et al. | 463/39 |
| 2007/0232255 | A1 * | 10/2007 | Masuda | 455/343.1 |
| 2007/0236184 | A1 * | 10/2007 | Bayne et al. | 320/137 |
| 2007/0259717 | A1 | 11/2007 | Mattice et al. | |
| 2007/0263555 | A1 * | 11/2007 | Enoki et al. | 370/311 |
| 2008/0013241 | A1 * | 1/2008 | Wong et al. | 361/114 |
| 2008/0014834 | A1 * | 1/2008 | Woolston | 446/473 |
| 2008/0064504 | A1 * | 3/2008 | Cole | 463/47 |
| 2008/0070703 | A1 * | 3/2008 | Campo et al. | 463/46 |
| 2008/0096659 | A1 * | 4/2008 | Kreloff et al. | 463/39 |
| 2008/0113800 | A1 * | 5/2008 | Ciavaglia et al. | 463/39 |
| 2008/0119273 | A1 * | 5/2008 | Yamada et al. | 463/39 |
| 2008/0129251 | A1 * | 6/2008 | Lam et al. | 320/149 |
| 2008/0133254 | A1 * | 6/2008 | Abe et al. | 705/1 |
| 2008/0153559 | A1 * | 6/2008 | de Weerd | 463/9 |
| 2008/0186410 | A1 * | 8/2008 | Hardacker et al. | 348/734 |
| 2008/0211455 | A1 * | 9/2008 | Park et al. | 320/108 |
| 2008/0268931 | A1 | 10/2008 | Alderucci et al. | |
| 2008/0311988 | A1 * | 12/2008 | Smith et al. | 463/36 |
| 2009/0005165 | A1 * | 1/2009 | Arezina et al. | 463/37 |
| 2009/0049554 | A1 * | 2/2009 | Vuong et al. | 726/26 |
| 2009/0054069 | A1 * | 2/2009 | Calnan et al. | 455/445 |
| 2009/0275354 | A1 * | 11/2009 | Bulmer | 455/522 |
| 2010/0130280 | A1 * | 5/2010 | Arezina et al. | 463/20 |

FOREIGN PATENT DOCUMENTS

| | | | | |
|---|---|---|---|---|
| WO | WO 2005/115572 | * | 12/2005 | A63F 7/02 |
| WO | 2006066631 | A1 | 6/2006 | |
| WO | WO 2007/015599 | * | 8/2007 | H02J 7/00 |

* cited by examiner

WIRELESS WAGERING SYSTEM

CROSS REFERENCE TO RELATED APPLICATION

This application claims the benefit of provisional patent application No. 61/003,031, filed Nov. 13, 2007, title "Wireless Wagering System." The entire contents of said application is incorporated herein by reference thereto.

BACKGROUND INFORMATION

Wagering games can include casino gambling, lotteries, instant-win tickets, etc. Some of these games involve interactive game-play between the game player and a gaming machine. For example, some casinos have video slot machines, which are video-based versions of conventional slot machines. Other types of video-based wagering machines are also possible.

The user's experience with a video-based wagering machine typically involves an interactive wagering session in which the game player sits near the gaming machine and physically interacts with controls of the gaming machine to place wagers and advance game-play. For example, the interaction can include pushing buttons, pulling levers, etc., which are physically located on the gaming machine. However, because wagering sessions involving a particular game player can be lengthy, several problems arise in regards to this typical user experience.

For example, the game player may become fatigued by continuously reaching out to the gaming machine to activate buttons or levers, located on the gaming machine, over a long period of time. This in turn may act to reduce the average length of the wagering session, which is undesirable for manufacturers of gaming machines, because to maximize profit associated with the wagering game, it is desirable for any given wagering session to be as long as possible. Additionally, because the game player must physically interact with buttons or levers located on the gaming machine, the player must necessarily remain physically proximate to the gaming machine. This can also act to undesirably reduce the length of a wagering session because the game player may become uncomfortable with being tethered to one physical location for a long time. For example, the game player may wish to interact with a companion a short distance away, but be unable to do so without forfeiting control of the gaming machine and ending the wagering session.

Other aspects of wagering games complicate and increase the difficulty of determining solutions to the problems discussed above. For example, by their very nature, wagering games involve the exchange of money and therefore security concerns, and this increases the difficulty of applying solutions from non-wagering game to wagering games. Additionally, because it is desirable for wagering games is to provide a pleasant and fun experience for the game player, the user experience typically involves the consumption of food and beverages, which can present undesirable consequences upon application to electronic equipment, such as electric shorting or other types of equipment failure.

BRIEF DESCRIPTION OF THE DRAWINGS

So that features of the present invention can be understood, a number of drawings are described below. It is to be noted, however, that the appended drawings illustrate only particular embodiments of the invention and are therefore not to be considered limiting of its scope, for the invention may encompass other equally effective embodiments.

DETAILED DESCRIPTION OF EXAMPLE EMBODIMENTS

Applicant has noted that there is a need in the art for a video-based wagering machine that encourages a game player to increase the average length of wagering sessions. Applicant has also noted that there is further a need for a video-based wagering machine that eases the physical strain and inconvenience of a game player. Moreover, it is desirable for any machine that answers these needs to be secure enough to not compromise the economic integrity of either the game player or the gaming machine. It is further desirable for any machine that answers these needs to also not inhibit the consumption of food and beverages, or overly impinge on the enjoyment of the game player.

Some example embodiments of the present invention are modified versions of traditional wagering machines such as slot machines, video lottery terminals, or other such machines. These machines may be provided with a wireless interface that eliminates the need for a player to stand continuously at the machine in order to continue their play. Thus a use can walk around, sit, or sit together with other players.

Figure 1:
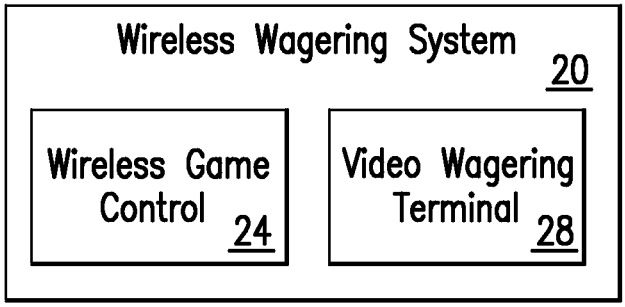
FIG. 1 is a schematic diagram depicting one embodiment of a wireless wagering system.

FIG. 1 is a schematic diagram depicting one embodiment of a wireless wagering system 20. The wireless wagering system 20 includes a wireless game control 24 and a video wagering terminal 28. The wireless game control 24 enables a game player to become physically relatively untethered from the video wagering terminal 28, enabling the game player to freely move about the vicinity of the video wagering terminal 28 of a predetermined size, all the while interacting with the video wagering terminal 28 within a wagering session, i.e., placing wagers and advancing game-play. The wireless wagering system 20 can thus encourages the game player to increase the average length of wagering sessions by providing the player with increased physical and mental comfort.

The wireless wagering system 20 is suitable for use with a variety of wagering games. For example, the wireless wagering system 20 can be used in conjunction with video slot machines, video poker machines, video blackjack machines, or any other type of video-based wagering machine.

Figure 2:
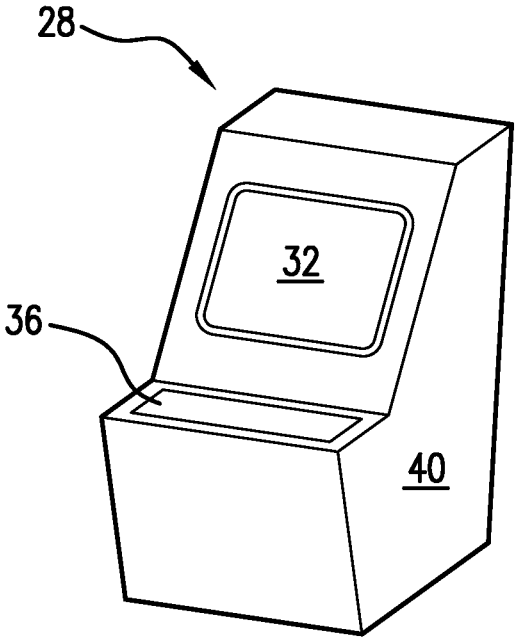
FIG. 2 depicts a perspective view of one embodiment of a video wagering terminal of the wireless wagering system.

FIG. 2 depicts a perspective view of one embodiment of the video wagering terminal 28. The video wagering terminal 28 is configured to implement a video-based wagering game, such as video slot, video poker, video blackjack, etc. FIG. 2 depicts a physical representation of the elements of the video wagering terminal 28 that are visible to the game player, which include a video display 32, a game control portion 36, and a terminal enclosure 40. The video display 32 is configured to output video information related to the wagering game, such as a video representation of the state of the wagering game, or prompts and messages intended to advance game-play and indicate the outcome of the wagering game. The game control portion 36 includes game controls for receiving game-play input from the game player. The game control portion 36 can include a plurality of game controls such as, for example, buttons, levers, or any other suitable game control. As discussed below, the game control also includes a cradle 68 (shown in, e.g., FIG. 3) to enable docking of the wireless game control 24. The enclosure 40 provides a physical housing for the video display 32 and game control portion 36. While FIG. 2 depicts a physical representation of the elements of the video wagering terminal 28 that are visible to the game player, other elements of the video wagering terminal 28 exist, and are discussed below.

Figure 3:
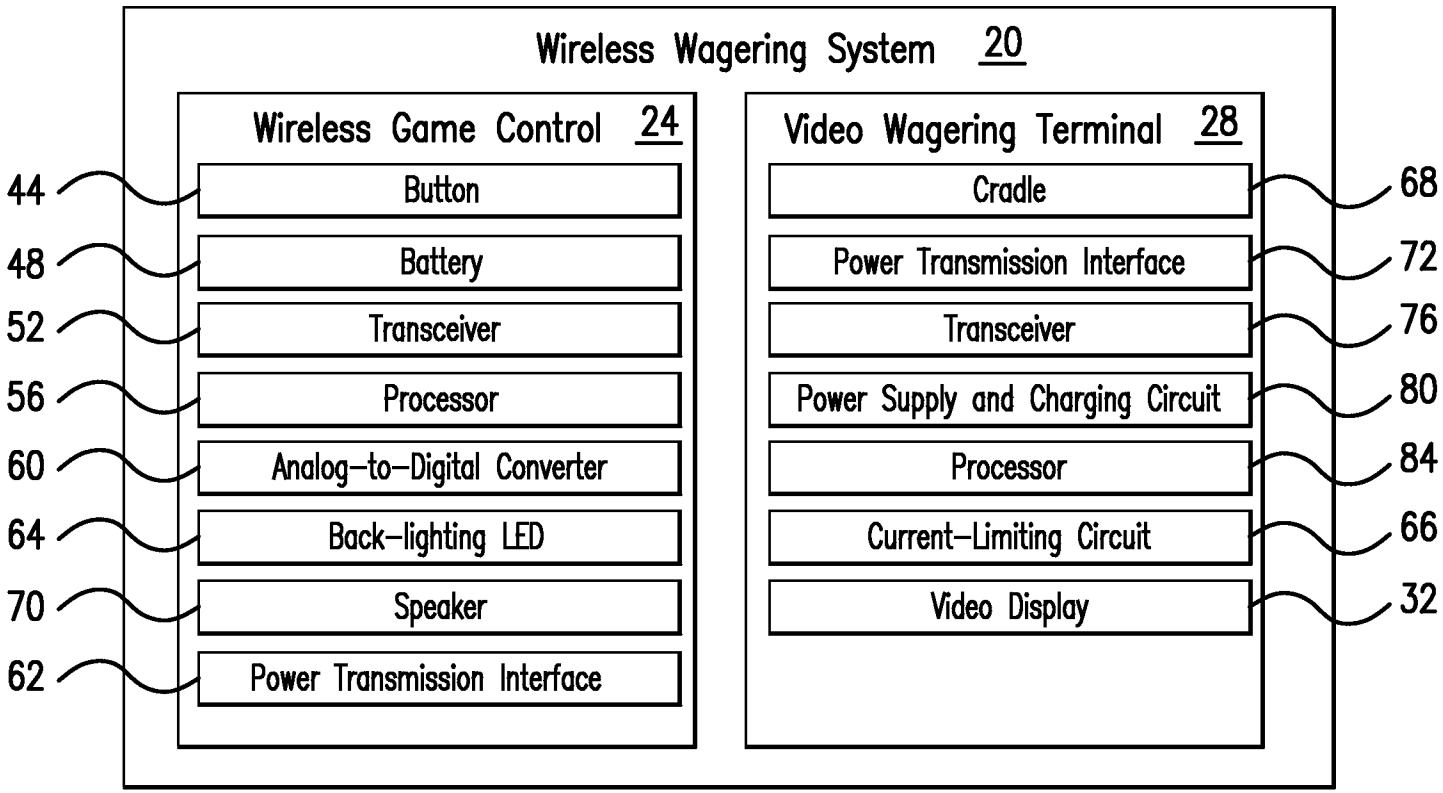
FIG. 3 is a schematic diagram depicting more detail concerning one embodiment of the wireless wagering system depicted in FIG. 1.

FIG. 3 is a schematic diagram depicting one embodiment of the wireless wagering system 20 in greater detail than in FIG. 1. In the depicted embodiment, the wireless game control 24 includes a button 44, a battery 48, a transceiver 52, a processor 56, an analog-to-digital converter (ADC) 60, a power transmission interface 62, a back-lighting light-emitting diode (LED) 64, and a speaker 70. Embodiments of the wireless game control 24 may have some or all of these components, as discussed below.

The button 44 is configured to receive game-play input from the game player. The battery 48 is configured to supply power to electric or electronic components of the wireless game control 24. The transceiver 52, also referred to herein as the first transceiver 52, is configured to communicate information between the wireless game control 24 and the video wagering terminal 28. The processor 56, also referred to herein as the first processor 56, is configured to control operational aspects of the wireless game control 24, for example in response to information communicated between the wireless game control 24 and the video wagering terminal 28. The ADC 60 is configured to convert an analog representation of the voltage and charging status of the battery to a digital representation of such. The power transmission interface 62, also referred to herein as the first power transmission interface 62, is configured to receive a power transmission from the video wagering terminal 28. The back-lighting LED 64 is configured to backlight the button 44 in response to a control signal from the first processor 56. The speaker 70 is configured to sound an alarm to alert the game player in the event the game player has strayed to far from the video wagering terminal. The operation of these components of the wireless game control 24 is discussed in greater detail below.

Regarding the video wagering terminal 28, the embodiment depicted in FIG. 3 includes a cradle 68, a power transmission interface 68, a second transceiver 76, a power supply and charging circuit 80, a second processor 84, a current-limiting circuit 66, and the video display 32. Certain embodiments of the wireless game control 24 may have some or all of these components, as discussed below.

The cradle 68 is configured to receive the wireless game control 24, that is, provide a docking port for the wireless game control 24. The power transmission interface 72, also referred to herein as the second power transmission interface 72, is configured to provide power transmission to the wireless game control 24, via the first power transmission interface 62, for purposes of powering the wireless game control 24 and charging the battery of the wireless game control 24 when the wireless game control 24 is docked in the cradle 68. The second transceiver 76 is configured to communicate information between the video wagering terminal 28 and the wireless game control 24. Although depicted as a transceiver in FIG. 3, in one embodiment it need only be a receiver. The power supply and charging circuit 80 is configured to supply power to the wireless game control 24, and charge the battery 48 of the wireless game control 24, through the power transmission interface, when the wireless game control 24 is docked in the cradle 68. The second processor 84 is configured to control operational aspects of the video wagering terminal 28, including with respect to the interaction of the video wagering terminal 28 and the wireless game control 24. The current-limiting circuit 66 is configured to limit the current supplied through the power transmission interface 72, e.g., by the power supply and charging circuit 80, in the case of an undesirable operational event such as, for example, a coin, liquid or other foreign object being introduced into the cradle 68 in a casino environment. The video display 32, as discussed above in regards to FIG. 2, is configured to output video information related to the wagering game to the game player.

Figure 4:
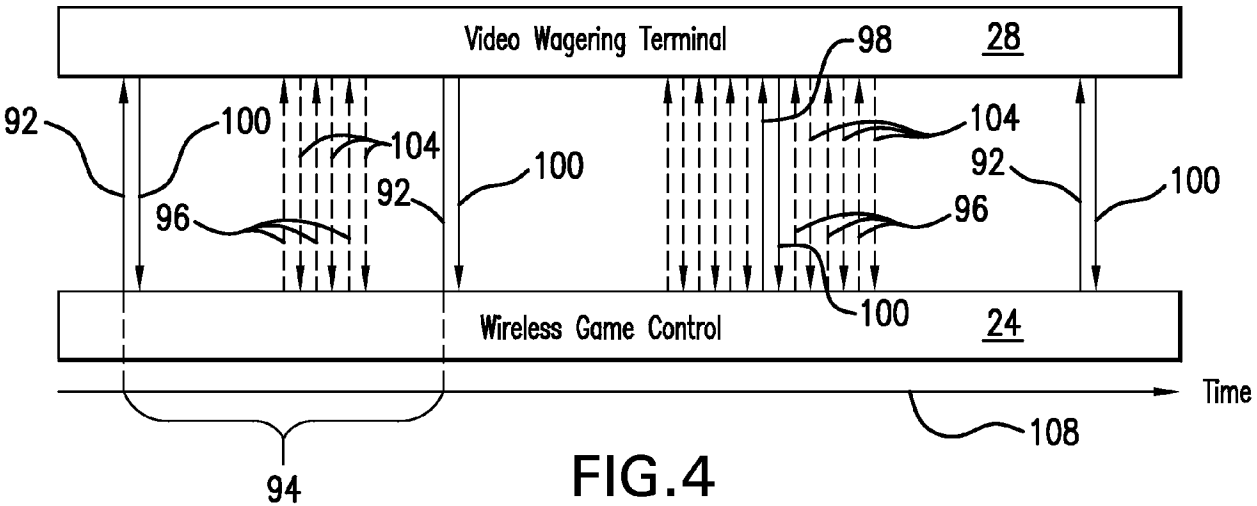
FIG. 4 is a flow chart depicting one embodiment of communication of master and slave data packets between a wireless game control and the video wagering terminal of the wireless wagering system.

FIG. 4 depicts one embodiment of communication between the wireless game control 24 and the video wagering terminal 28 unfolding over the course of time (as indicated by time axis 108). In the depicted embodiment, the wireless game control 24 is the master and the video wagering terminal 28 is the slave for purposes of communication between the two, and communication between the wireless game control 24 and the video wagering terminal 28 is always initiated by the wireless game control 24. The wireless game control 24 sends a master data packet 90 to the video wagering terminal 28, and in response to receiving the master data packet 90, the video wagering terminal sends a slave data packet 98 back to the wireless game control 24. One reason this master-slave communication format is advantageous is that it enables fluid, timely communication of game-play input received from the game player at the wireless game control 24 to the video wagering terminal 28, and timely operational control information from the video wagering terminal 28 to the wireless game control 24.

The processor of the wireless game control 24 can be configured to initiate transmission of master data packets 90 to the video wagering terminal 28 in each of at least two different situations. In the first type of master data packet transmission 92, the master data packet 90 is transmitted periodically at the end of a predetermined periodic time period 94. In FIG. 4, the periodic transmission 92 of the master data packet 90 is indicated by the solid lines of communication extending from the wireless game control 24 to the video wagering terminal 28. The periodic master data packet transmission 92 is advantageous to enable communication between the wireless game control 24 and the video wagering terminal 28 that doesn't necessarily depend on game-play input from the game player. For example, communication concerning the state of the battery 48 of the wireless game control 24, such as the voltage of the battery 48 or the battery charging status, is advantageously accomplished at least through the periodic master data packet transmission 92.

In the second type of master data packet transmission 96, the transmission of the master data packet 90 is triggered in response to each game-play input received at the wireless game control 24 from the game player. In FIG. 4, the game-play-controlled transmission 96 of the master data packet 90 is indicated by the dashed lines of communication extending from the wireless game control 24 to the video wagering terminal 28. The game-play-controlled master data packet transmission 96 is advantageous to enable communication between the wireless game control 24 and the video wagering terminal 28 that is related to game-play input from the game player. For example, communication of the game-play input itself is advantageously accomplished at least through the game-play-controlled master data packet transmission 96.

As depicted in FIG. 4, in the master-slave mode of communication, in response to each master data packet transmission 92, 96 from the wireless game control 24 to the video wagering terminal 28, the video wagering terminal 28 transmits the slave data packet 98 back to the wireless game control 24. The second processor 84 of the video wagering terminal 28 can be configured to monitor the second transceiver 76 for receipt of the master data packet 90, and control the preparation and return transmission of the slave data packet 98. One advantage to transmitting the slave data packet 98 in response to the master data packet 90 is that it enables the video wagering terminal 28 to analyze and respond to the information contained in the master data packet 90, and deliver relevant control information back to the wireless game control 24, in a timely fashion to ensure the proper operation of aspects of the wireless wagering system 20. In FIG. 4, the transmission 100, 104 of the slave data packet 98 is indicated either by solid or dashed lines of communication extending from the video wagering terminal 28 to the wireless game control 24, in the case of either a periodic slave transmission 100 (in response to the periodic master data packet transmission 92) or a game-play-controlled slave transmission 104 (in response to the game-play-controlled master data packet transmission 96), respectively.

Note that, although FIG. 4 depicts a master-slave mode for communication between the wireless game control 24 and the video wagering terminal 28, other embodiments need not necessarily employ a master-slave format. That is, in other embodiments, the video wagering terminal 28 is not obligated to return the slave data packet 98 for each master data packet 90 received. In such embodiments, the video wagering terminal 28 can still send either the periodic or game-play-control master data packet transmission 92, 96, or both, but the video wagering terminal 28 is not obligated to return the slave data packet 98. In such embodiments, the description below of the content of the master data packet 90 is still valid, although the data packet 90 is not necessarily a master. Moreover, in such embodiments, the second transceiver 76 need not necessarily include a transmitter, and instead need only include a receiver, and therefore not necessarily be a transceiver.

Figure 5:
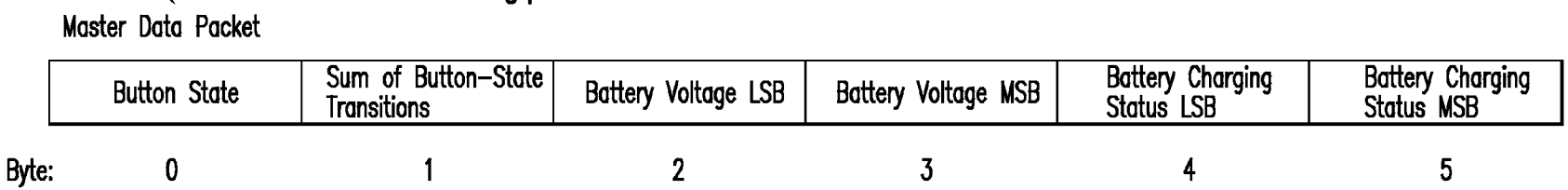
FIG. 5 is a schematic diagram depicting one embodiment of the master data packet.

FIG. 5 depicts one embodiment of the master data packet 90 that is transmitted from the wireless game control 24 to the video wagering terminal 28. In the depicted embodiment, the master data packet 90 has six different bytes, bytes 0-5, each holding a different piece of information.

Bytes 0 and 1 hold information related to the game-play input received at the button from the game player. The first processor 56 is configured to monitor the game-play input received at the button 44 and generate the information contained in bytes 0 and 1. As discussed in regards to FIG. 4, the first processor 56 can be configured to generate the master data packet 90 and initiate the game-play-controlled transmission 96 of the master data packet 90 in response to each game-play input received at the button 44.

Byte 0 holds information which represents the state of the button 44. The button 44 can be a two-state button, having either a depressed state or a non-depressed state, or a multi-state button, having more than two states, such as, for example, states which can depend on relative levels of depression of the button, or relative levels of force used to depress the button. Byte 1 holds information that represents a current sum of button-state transitions. For the two-state button, a button-state transition can be either a high-to-low transition representing a transition from the undepressed state to the depressed state of the button, or a low-to-high transition, representing a transition from the depressed state to the undepressed state of the button. For the multi-state button, the button-state transition information can take other forms. The information in byte 1 represents a current sum of a predetermined type of button-state transitions starting from a predetermined point in time. The type of button-state transitions included in the sum can include only one type of button state transition, for example a high-to-low transition, or a plurality of types of button-state transitions, such as all of the types of button-state transitions for a particular type of button 44. The predetermined point in time at which the sum begins can be selected according to the wagering game implemented by the video wagering terminal 28. For example, the current sum can be the sum extending from the beginning of a wagering session associated with a particular game player, a sum extending from a beginning of a particular wagering game, or a sum extending from a particular point of game-play transition within a particular wagering game.

Returning to FIG. 5, bytes 2 and 3 contain information that represents the current voltage of the battery 48. In the depicted embodiment, byte 2 contains a least-significant byte (LSB) of the current battery voltage, and byte 3 contains the a significant byte (MSB) of the current battery voltage. The communication of the battery voltage in the master data packet 90 from the wireless game control 24 to the video wagering terminal 28 is advantageous to enable the second processor 84 of the video wagering terminal 28 to perform control operations according to this information. The second processor 84 can process the master data packet 90 and generate information for display to the game player on the video display 32. Such information can include a first indicator, displayed at least when the wireless game control 24 is not in the cradle 68, which includes a representation of a charge remaining on the battery 48. For example, the first indicator can include a battery status bar having a plurality of possible indicator levels configured to selectively indicate a plurality of different levels of charge remaining on the battery 48. In another example, the first indicator can includes a message advising the game player to place the wireless game control 24 in the cradle 68. The message can be generated in response to a determination, based on battery voltage information in the master data packet 90, that the voltage of the battery 48 has dropped below a predetermined level.

Bytes 4 and 5 of the embodiment of the master data packet 90 depicted in FIG. 5 contain information that represents the current charging status; of the battery 48. In the depicted embodiment, byte 4 contains an LSB of the current charging status, and byte 5 contains an MSB of the current charging status. The communication of the current charging status of the battery 48 is advantageous to enable the second processor 84 of the video wagering terminal 28 to perform control operations, regarding the charging of the battery 48, according to this information. The second processor 84 can also process the master data packet 90 and generate information for display to the game player on the video display 32, and such information can include a second indicator, to be displayed at least when the wireless game control 24 is in the cradle 68, which is a representation of the charging status of the battery 48.

The ADC 60 of the wireless game control 24 is configured to convert analog measurements of the battery voltage and the charging status of the battery 48 to digital representations of these quantities, including the current battery voltage LSB and MSB of bytes 2 and 3, and the current battery charging status LSB and MSB of bytes 4 and 5, as depicted in FIG. 5. The ADC 60 can be a separate component of the wireless game control 24, or a portion of one of the other components also explicitly shown in FIG. 3, such as the first processor 56 or the battery 48. In one example, the ADC 60 can be configured to measure and convert the voltage at terminals of the battery 48 and the current coming into or out of terminals of the battery 48. The voltage of the battery 48 and the current coming out of the battery 48 can be used to determine an amount of charge remaining on the battery 48. The voltage of the battery 48 and the current coming into the battery 48 can be used to generate the battery charging status information.

One advantage of splitting information in the master data packet 90 into MSB and LSB portions, such as the battery voltage MSB and LSB, and the battery charging status MSB and LSB, is that this splitting can facilitate the processing of this information by the second processor 84.

Figure 6:
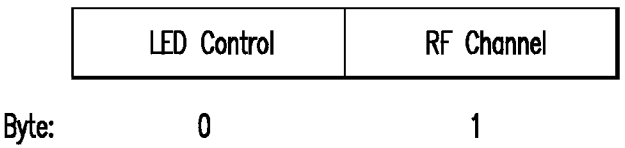
FIG. 6 is a schematic diagram depicting one embodiment of the slave data packet.

FIG. 6 depicts one embodiment of the slave data packet 98 that is transmitted from the video wagering terminal 28 to the wireless game control 24 in response to the master data packet transmission 92, 96. In the depicted embodiment, the slave data packet 98 has two bytes, including a byte 0 and a byte 1. Byte 0 contains information related to control parameters for the backlighting LED 64 of the wireless game control 24. The control parameters can be used to activate or deactivate operation of the LED 64. That is, byte 0 of the slave data packet 98 can contain information which instructs the first processor 56 to either activate or deactivate the LED 64. For example, to conserve battery power, the operation of the LED 64 may be deactivated when the wireless game control 24 is not docked in the cradle 68. Upon a determination that the wireless game control 24 is not docked, made either by the second processor 84, or communicated to the second processor 84 after being made by the first processor 56, the second processor 84 can generate the instruction regarding deactivation of the LED 64 for inclusion in the slave data packet 98. Other types of control instructions can also be sent to wireless game control 24 in regard to the LED 64. For example, the LED 64 can be placed into a low-power mode, in which it lights more dimly than in a relatively higher-power mode. The LED 64 can also be placed into various types of blinking mode, such as a first blinking mode in which the LED 64 blinks in response to certain button-state transitions, or a second blinking mode in which the LED 64 either turns on or off in response to certain button states.

Byte 1 of the embodiment of the slave data packet 98 depicted in FIG. 6 includes information related to an RF communication channel to be used for communication between the wireless game control 24 and the video wagering terminal 28. Byte 1 can be used to instruct the wireless game control 24 to use a particular RF communication channel to communicate the master data packet 90 to the video wagering terminal 28. The wireless game control 24 and the video wagering terminal 28 can cooperatively determine which communication channel to use, such as by using an auto-binding protocol, and byte 1 can be used to accomplish this. Other ways of determining which communication channel to use are also possible, and which also employ byte 1 to communicate the determined channel. For example, byte 1 can be used to communicate a predetermined communication channel that is set, e.g., via an optional configuration interface (not shown) of the video wagering terminal 28.

Generally regarding FIGS. 5 and 6, note that although the master data packet 90 and the slave data packet 98 are depicted as being divided into portions which are byte-sized, other configurations of the master data packet 90 and slave data packet 98 are also possible, and the master data packet 90 and slave data packet 98 can be divided according to other schemes and still contain the information discussed above. For example, the various portions of the master data packet 90 and the slave data packet 98 may be other than byte-sized, or there may be non-uniformly sized data divisions.

Figure 7A:
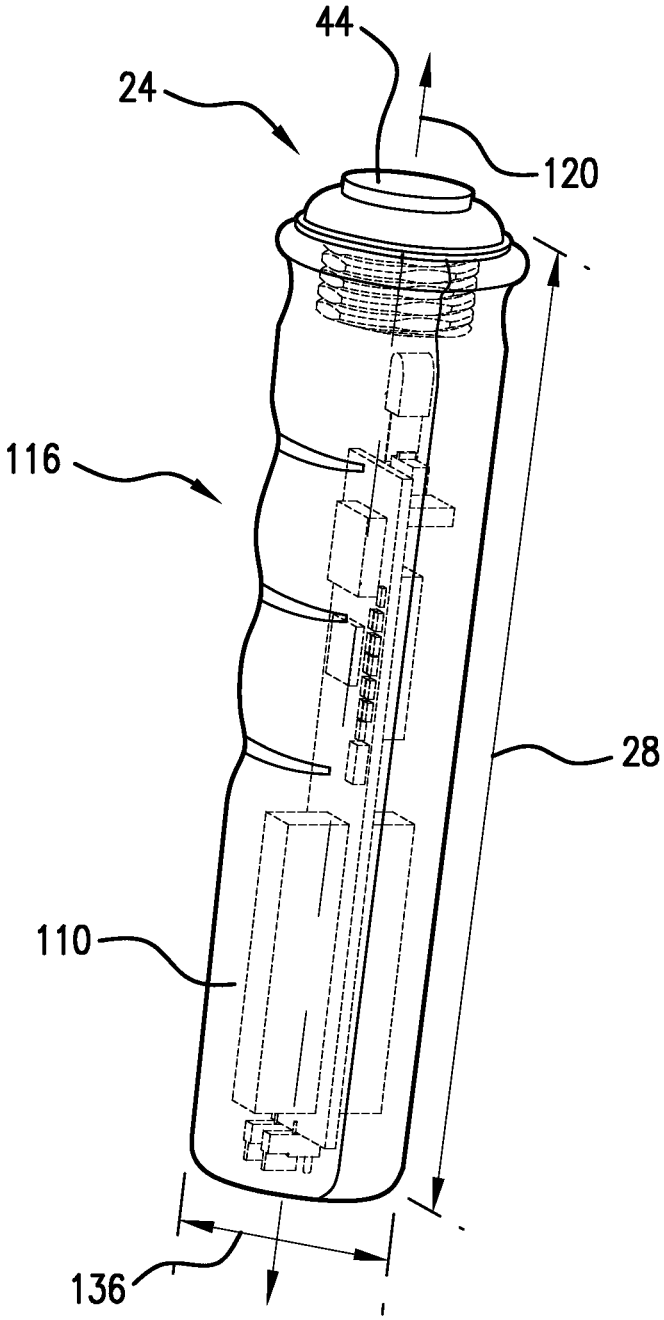
FIG. 7A depicts a perspective view of one embodiment of the wireless game control of the wireless wagering system.
Figure 7B:
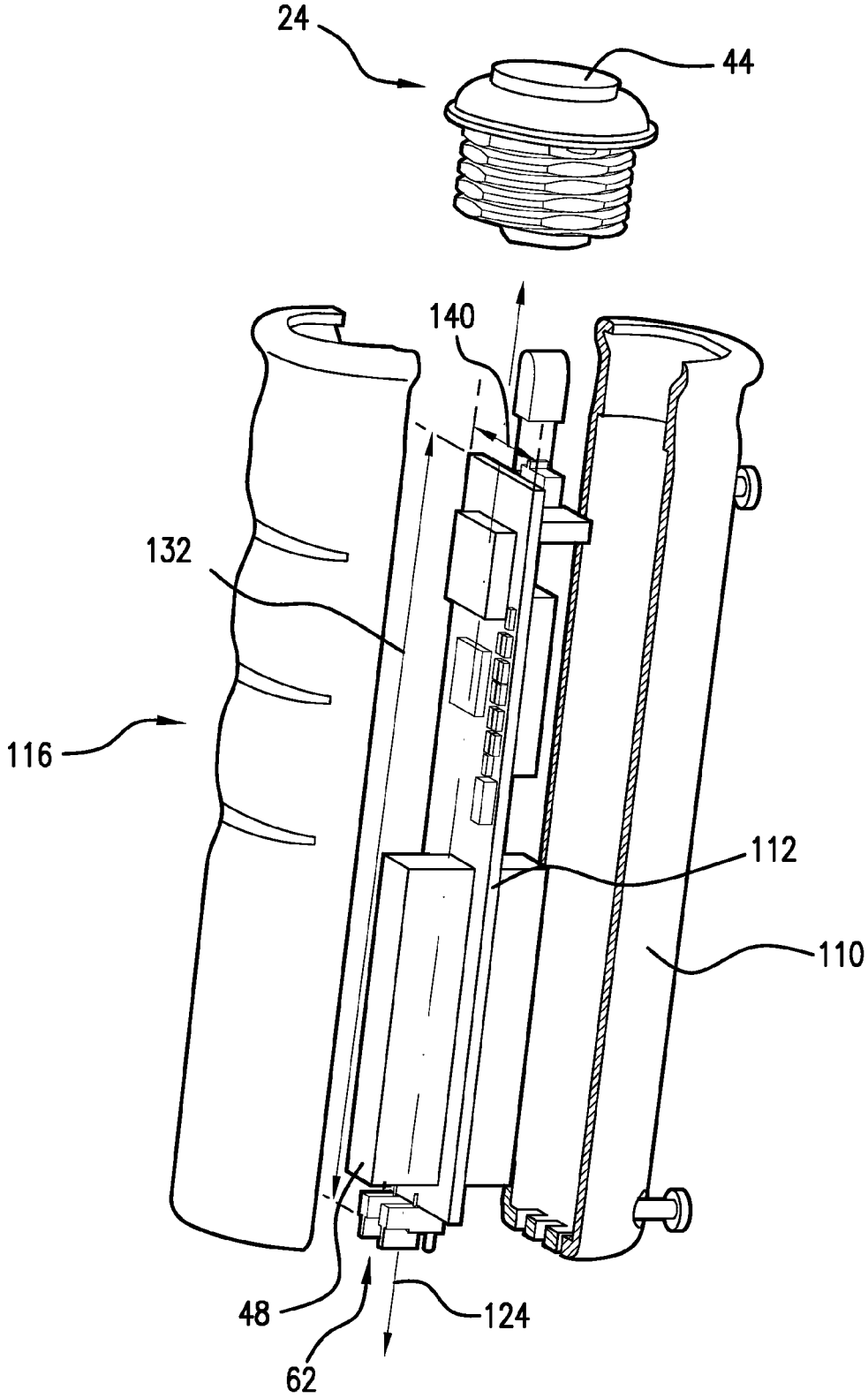
FIG. 7B depicts an exploded perspective view of the embodiment of the wireless game control depicted in FIG. 7A.

FIG. 7A depicts a perspective view of one embodiment of a physical implementation of the wireless game control 24. FIG. 7B depicts an exploded perspective view of the embodiment of the wireless game control 24 depicted in FIG. 7A, showing additional detail concerning components of the wireless game control 24 which are not readily visible in the view of FIG. 7A. In the embodiment depicted in FIGS. 7A and 7B, in additional to some or all of the components already discussed above in connection with FIG. 3, the wireless game control 24 includes a case 110 and a circuit board 112. The case 110 generally houses and arranges all of the components of the wireless game control 24, as well as provides a physical interface 116 to the hand of the game player. The circuit board 112 provides a platform for arranging the various electrical and electronic components of the wireless game control 24 in the context of the case 110 and its physical interface 116 to the hand of the game player.

One advantage of the physical interface 116 provided by the case depicted in FIGS. 7A and 7B is that its design provides improved comfort and reduced strain to the hand of the game player during game-play. To provide these advantageous aspects, the case 110 and the circuit board 112 have been structured to have aligning associated longitudinal axes 120, 124. That is, the case 110 has an overall length 128 along a first longitudinal axis 120 associated with the case 110, and the circuit board 112 as a overall length 132 along a second longitudinal axis 124 of the circuit board 112, which are respectively greater than an overall width 136 of the case 110 in a dimension perpendicular to the first longitudinal axis 120 and an overall width 140 of the circuit board 112 in a dimension perpendicular to the second longitudinal axis 124. Furthermore, the first and second longitudinal axes 120, 124 have been aligned be parallel and minimally offset, in order to coalesce the physical implementation of the wireless game control 24 about the mutually aligned longitudinal axes 120, 124 to produce the advantageous physical interface 116. That is, in one embodiment, the first and second longitudinal axes 120, 124 associated with the case 110 and the circuit board 112, respectively, pass through longitudinal centerlines of the case 110 and circuit board 112, and are offset from each other by less than the smaller either of the overall width 136 of the case 110 or the overall width 140 of the circuit board 112.

As also depicted in the embodiment shown in FIG. 7B, the battery 48 is arranged to pass through the circuit board 112. That is, a portion of the battery 48 exists on both sides of the circuit board 112. Such a positioning of the battery 48 advantageously enables a closer alignment of the first and second longitudinal axes 120, 124 in order to achieve the improved-comfort and reduced-strain characteristics of the physical interface 116 of the wireless game control 24.

Figure 8A:
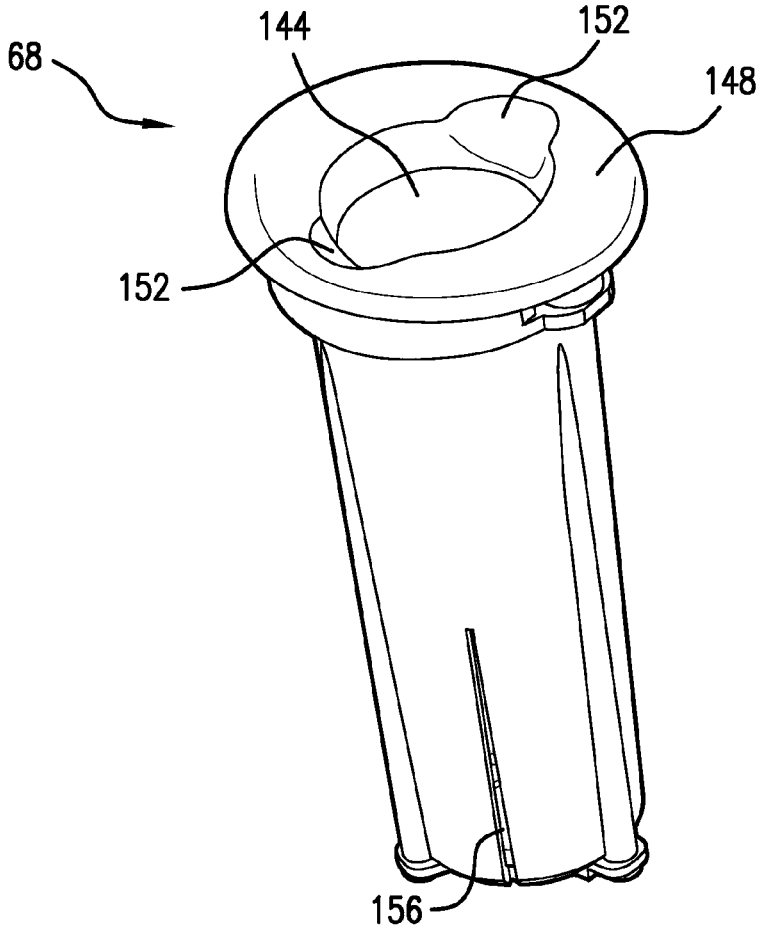
FIG. 8A depicts a perspective view of one embodiment of a cradle for the wireless game control.
Figure 8B:
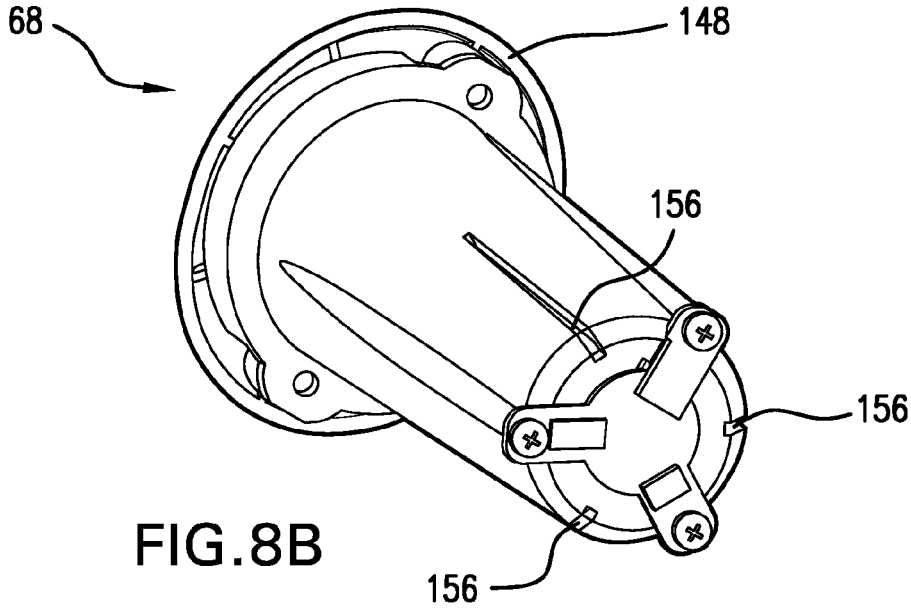
FIG. 8B depicts another perspective view of the embodiment of the cradle depicted in FIG. 8A.

FIG. 8A depicts a perspective view of one embodiment of a physical implementation of the cradle 68 which provides docking for the wireless game control 24. FIG. 8B depicts another perspective view of the embodiment of the cradle 68 depicted in FIG. 8A. In the embodiment depicted in FIGS. 8A and 8B, the cradle 68 has a receiving opening 144, a lip region 148 having a plurality of recessed portions 152, and a plurality of drainage openings 156. The receiving opening 144 is configured to receive the wireless game control 24 without respect to the rotational orientation of the wireless game control 24. That is, the receiving opening 144 can accept the wireless game control 24 in any orientation, so long as it is placed in the cradle 68 bottom (non-button side) first. The lip region 148 having the plurality of recessed portions 152 allows easy access for a game player to remove the wireless game control 24 from the cradle 68. The plurality of drainage openings 156 allow any liquid that is spilled in the cradle 68, such as a beverage in a casino environment, to drain out of the cradle 68. This helps prevent damage to the wireless game control 24 by the presence of liquids.

The first and second power transmission interfaces 62, 72 can be either inductive power transmission interfaces or wired power transmission interfaces. In either scenario, the current-limiting circuit 66 can be configured to limit the current supplied through the power transmission interface 68 in the case of an undesirable operational event. For example, the game player may unwittingly drop a coin, or spill liquid, into the cradle 68 through the receiving opening 144. In such an event, the coin, or even the liquid before it passes through the drainage openings 156, may present an electrical short, or otherwise undesirable electrical condition, to the power transmission interface 68. To safeguard against such, the current-limiting circuit 68 can limit the current supplied through the power transmission interface 68 (e.g., by the power supply and charging circuit 80) to a value which prevents damage to components of the video wagering terminal 28.

Figure 9:
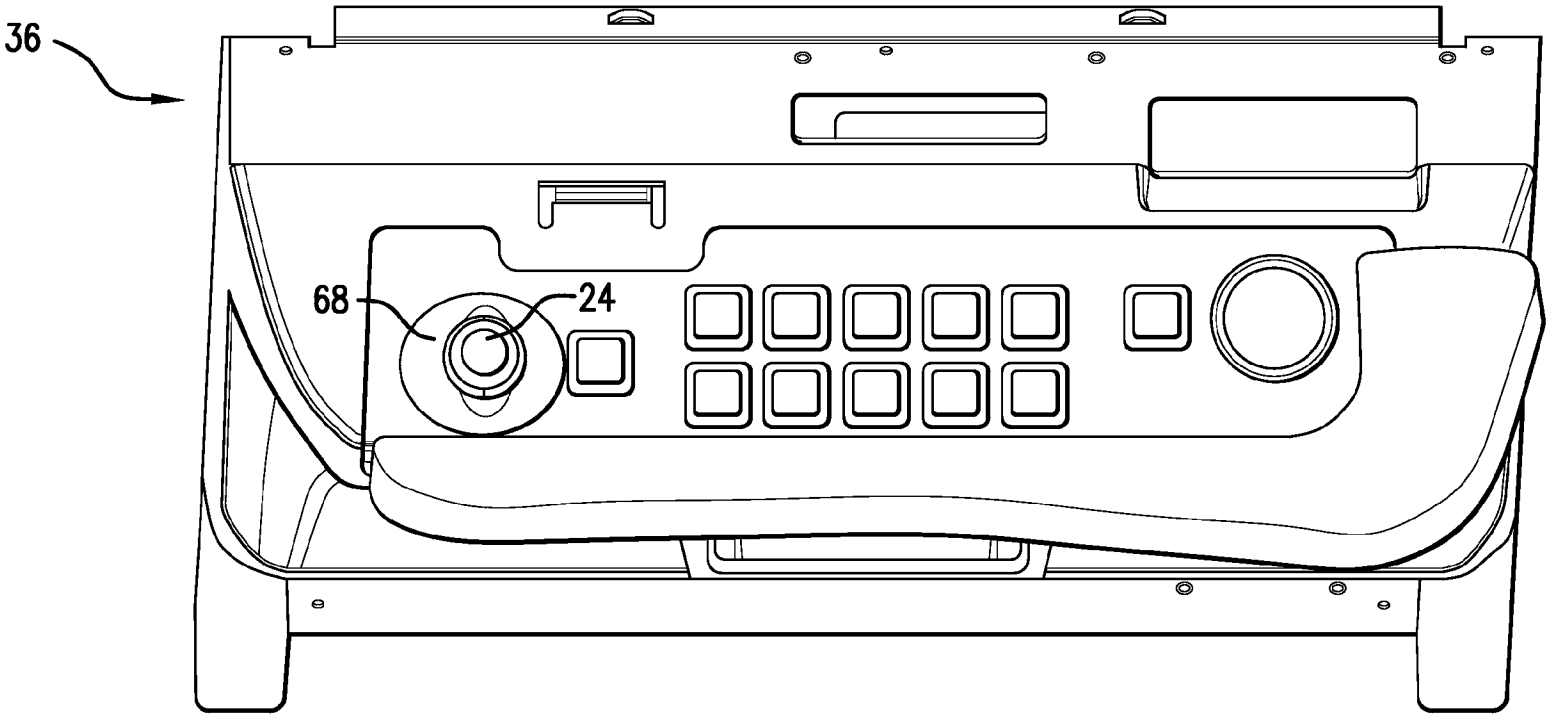
FIG. 9 depicts a perspective view of one embodiment of a game control portion of the video wagering terminal.

FIG. 9 depicts a perspective view of one embodiment of the game control portion 36 of the video wagering terminal 28, in which the cradle 68 is located in the game control portion 36. In the depicted embodiment, the wireless game control 24 is shown docked in the cradle 68.

Figure 10:
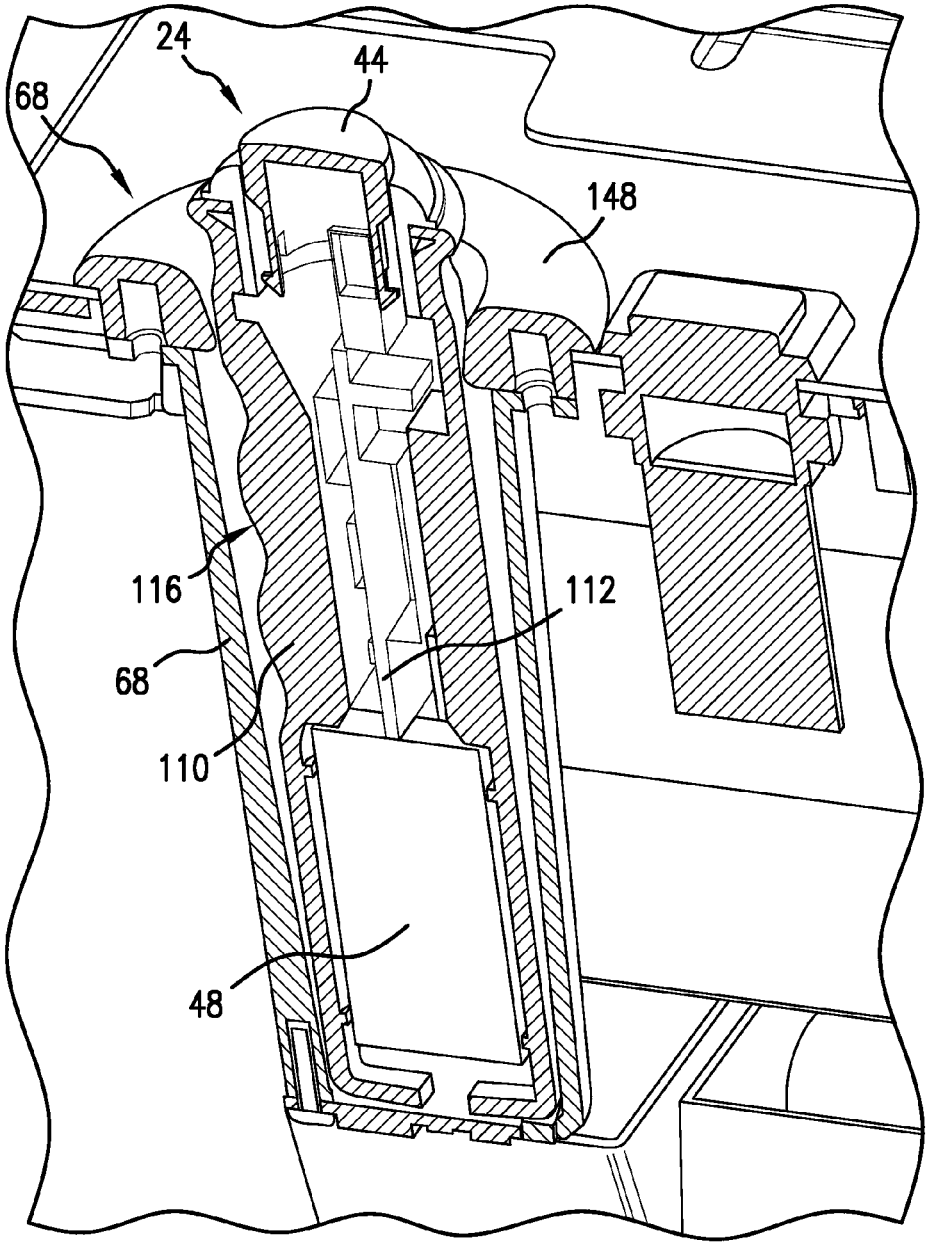
FIG. 10 depicts a sectional perspective view showing more detail concerning one embodiment of the positioning of the cradle within the game control portion depicted in FIG. 9, and the docking of the wireless game control in the cradle.
Figure 11:
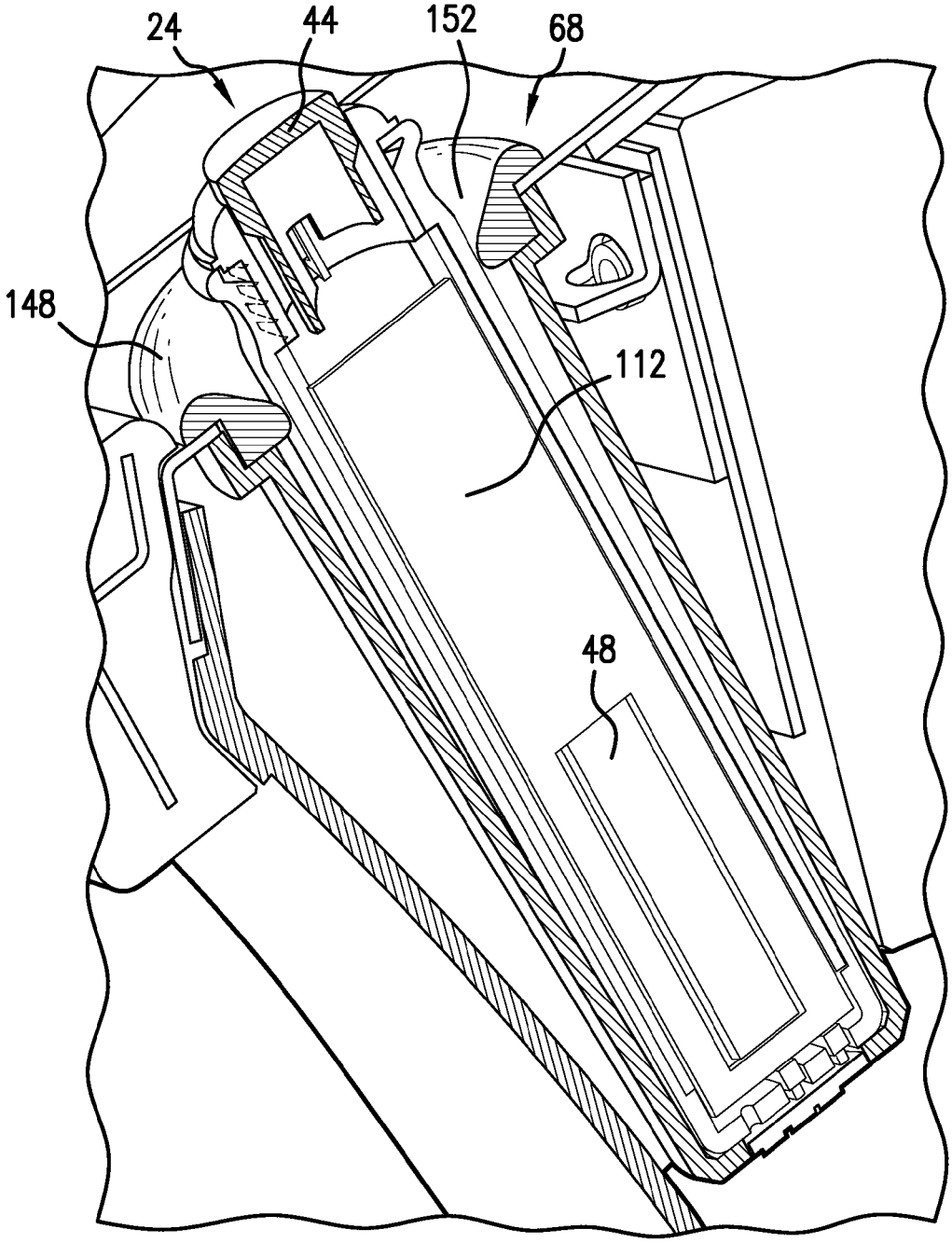
FIG. 11 depicts another sectional perspective view showing more detail concerning the embodiment of the positioning of the cradle within the game control portion and the docking of the wireless game control in the cradle depicted in FIG. 10.

FIG. 10 depicts a cross-sectional perspective view of one embodiment of the wireless game control 24 docked in the cradle 68 located in the game control portion 36 of the video wagering terminal 28. FIG. 11 depicts a different cross-sectional perspective view of the embodiment of the wireless game control 24 docked in the cradle 68 located in the game control portion 36 of the video wagering terminal 28 depicted in FIG. 10.

The wireless game control 24 can optionally include a plurality of the buttons 44. The wireless game control 24 can also optionally include one or more other game controls besides the button 44, such as a lever, a wheel, a spinner, etc. The wireless game control 24 can also optionally include some type of haptic feedback element, such as a vibrator, which can be activated in response to game-play events. The speaker 70 of the wireless game control can also optionally be activated in response to game-play events.

The game control portion 36 of the video wagering terminal 28 can optionally include a plurality of cradles 68 to enable docking of a plurality of wireless game controls 24. Also, the cradle 68 for docking the wireless game control 24 can optionally be alternatively or additionally located in a location other than the game control portion 36 of the video wagering machine 28. For example, the cradle 68 can additionally or alternatively be located in an armrest of a seat. Such a seat can be used by the game player for sitting near the video wagering terminal 28. In such an embodiment, the alternative or additional location of the cradle 68 can optionally include a plurality of cradles 68 to enable docking of a plurality of wireless game controls 24.

The wireless wagering system 20 can be configured to sound an alarm when the wireless game control 24 is beyond a predetermined distance from the video gaming terminal 28. For this purpose, the speaker 70 of the wireless game control 24 is configured to generate an alarm at a predetermined volume. The predetermined volume is loud enough to be heard in a casino environment, but not so loud or jarring as to overly disturb or intrude on the pleasure of the game player. The first processor 56 is configured to monitor a measure of the distance of the wireless game control 24 from the video wagering terminal 28 and control the speaker 70 to sound the alarm in response to the measure indicating the wireless game control 20 is beyond the predetermined distance from the video gaming terminal 28.

The distance measure used by the first processor 56 for the purposes of triggering the alarm can be based on the amount of time that elapses after the first transceiver 52 sends the master data packet 90 and does not yet received the slave data packet 98 in return. For example, the first processor 56 can determine the distance measure based on not receiving the slave data packet 98 within a predetermined elapsed time after sending the master data packet 90. In conjunction with such a distance measure, the first and second transceivers 52, 76 can be configured to not successfully transmit master and slave data packets 90, 98, respectively, beyond a predetermined distance. The selected predetermined distance therefore represents the limit of the separation distance between the wireless game control 24 and the video wagering terminal 28 in which the wireless wagering system 20 is functional to communicate game-play input from the wireless game control 24 to the video wagering terminal 28.

In order to accommodate security concerns, the wireless wagering system 20 can be configured to do one or all of the following: transmit the master data packet 90 on a predetermined one of a plurality of RF channels; encode the master data packet 90 using a pseudo-random noise (PN) code; generate a cyclic redundancy check (CRC) value for the master data 90 packet using a CRC seed value; or transmit the master data packet 90 using a custom addressing protocol.

Further embodiments are also possible, which are the result of variously combining elements or embodiments described herein. For example, embodiments of the wireless game control 24, video wagering terminal 28, or both, which contain only those components which are necessary to implement any subset of the functions described above, are also possible.

What is claimed is:

1. A wireless wagering system, comprising:

a video wagering terminal, comprising:

a cradle configured to receive a wireless game control and provide a power transmission interface between the wireless game control and the video wagering terminal when the wireless game control is in the cradle, wherein the cradle is configured to:

receive the wireless game control without regard to a rotational orientation of the wireless game control, and enable liquid spilt into the cradle to drain out of the cradle from a plurality of drainage openings;

a terminal transceiver configured to receive a master data packet from the wireless game control;

a power supply and battery-charging circuit configured to supply power to the wireless game control and charge the battery of the wireless game control through the power transmission interface when the wireless game control is in the cradle, wherein the power transmission interface is an inductive power transmission interface;

wherein the wireless game control comprises:

a button configured to receive game-play input from a game player;

a battery configured to supply power to the wireless game control;

a first transceiver configured to transmit the master data packet from the wireless game control to the video wagering terminal, wherein the master data packet has a payload which includes first information related to a voltage of the battery and second information indicating a charging status of the battery, wherein the information indicating a charging status of the battery is determined at least in part by a measurement of electric current coming into the battery.

2. The wireless wagering system of claim 1, wherein the wireless game control further comprises:

a first processor configured to monitor the battery and generate the information related to the voltage and charging status of the battery included in the master data packet.

3. The wireless wagering system of claim 1, the video wagering terminal further comprising:

a video display screen configured to provide information to the game player; and a second processor configured to:

process the master data packet received from the wireless game control and generate the information for display to the game player on the video display screen, the generated information including:

a first indicator to be displayed at least when the wireless game control is not in the cradle, the first indicator displaying a representation of a charge remaining on the battery, wherein the second processor controls the generation of the first indicator in response to information in the master data packet related to the voltage of the battery; and a second indicator to be displayed at least when the wireless game control is in the cradle, the second indicator displaying a representation of the charging status of the battery and being generated by the second processor based on the information in the master data packet related to the charging status of the battery.

4. The wireless wagering system of claim 3, wherein the first indicator includes a plurality of battery status indicator levels configured to indicate a plurality of different levels of charge remaining on the battery.

5. The wireless wagering system of claim 3, wherein the first indicator includes a message advising the game player to place the wireless game control in the cradle, the message being generated by the second processor in response to a determination, based on information in the master data packet, that the voltage of the battery has dropped below a predetermined level.

6. The wireless wagering system of claim 1, the wireless game control further comprising:

an analog-to-digital converter configured to convert an analog measurement of the voltage of the battery to a digital representation suitable for transmission as the information related to the voltage of the battery in the master data packet.

7. The wireless wagering system of claim 1, wherein the first processor is configured to initiate transmission of the master data packet upon:

receipt of every game-play input from the game player, and periodically at the end of predetermined periodic time period.

8. The wireless wagering system of claim 1, wherein the first transceiver is configured to:

transmit the master data packet on a predetermined one of a plurality of RF channels;

encode the master data packet using a pseudo-random noise (PN) code;

generate a cyclic redundancy check (CRC) value for the master data packet using a CRC seed value; and transmit the master data packet using a custom addressing protocol.

9. The wireless wagering system of claim 2, further comprising:

a speaker configured to generate an alarm;

a processor configured to monitor a measure of the distance of the wireless game control from the video wagering terminal and control the speaker to sound the alarm in response to the measure indicating the wireless game control is beyond a predetermined distance from the video gaming terminal, wherein the first transceiver is configured to send a master data packet to a second transceiver of the video wagering terminal, and receive a slave data packet from the second transceiver in response to the second transceiver receiving the master data packet and wherein the processor is configured to determine the distance measure based on not receiving the slave data packet within a predetermined elapsed time after sending the master data packet.

10. A wireless wagering system, comprising:

a wireless game control, comprising: a button configured to receive game-play input from a game player, wherein the game-play input includes a sequence of a plurality of button-state transitions;

a first processor configured to monitor the game-play input and generate information related to a current button-state and information related to a current sum of the plurality of button-state transitions from a predetermined point in time, based on the game-play input; and a first transceiver configured to transmit a master data packet from the wireless game control to a video wagering terminal, wherein the master data packet has a payload which includes the information related to the current button-state and the information related to the current sum of the plurality of button-state transitions from a predetermined point in time;

a second processor configured to receive the master data packet from the wireless game control and advance game-play according to the information related to the current button-state and the current sum of the plurality of button-state transitions;

wherein the video wagering terminal further comprising: a cradle configured to receive the wireless game control, wherein the cradle is configured to receive the wireless game control without regard to a rotational orientation of the wireless game control, and enable liquid spilt into the cradle to drain out of the cradle from a plurality of drainage openings.

11. The wireless wagering system of claim 10, wherein the received game-play input includes a plurality of each of:

(i) a high-to-low button-state transition from an undepressed state to a depressed state, and (ii) a low-to-high button-state transition from a depressed state to an undepressed state.

12. The wireless wagering system of claim 10, the wireless control device further comprising:

a case having:

a grip portion configured to be gripped by the hand of the game player, a first end configured to connect to the button, and a first length along a first longitudinal axis, intersecting the button, that is greater than a first width of the case perpendicular to the first longitudinal axis; and a circuit board to which the first transceiver and the first processor are attached, the circuit board having a second length along a second longitudinal axis that is greater in magnitude than a second width of the circuit board perpendicular to the second longitudinal axis, wherein the second longitudinal axis also intersects the button and is parallel to the first longitudinal axis.

13. The wireless wagering system of claim 10, wherein the video wagering terminal comprises a current-limiting circuit configured to limit the current supplied by a power supply and charging circuit of the video wagering terminal in an event in which the cradle contains at least one of: liquid, a coin, or an unintended foreign object other than the wireless game control.

14. The wireless wagering system of claim 10, wherein the video wagering terminal further comprises a second transceiver to receive the master data packet from the first transceiver.

15. The wireless wagering system of claim 10, wherein the information related to the current button-state is provided in a first byte of the master data packet and information indicating the current sum of the plurality of button-state transitions is provided in a second byte of the master data packet.

16. A wireless wagering system, comprising:

a wireless game control, comprising:

a button configured to receive game-play input from a game player;

a light-emitting diode (LED) configured to be selectively activated to back-light the button;

a first transceiver configured to receive a slave data packet from a video wagering terminal, wherein the slave data packet has a payload which includes information related to an activation status of the LED and an RF communication channel to be used by the first transceiver for communicating with the video wagering terminal;

a first processor configured to control the activation status of the LED and the communication channel used by the first transceiver in response to the information in the slave data packet;

a case having:

a grip portion configured to be gripped by the hand of the game player, a first end configured to connect to the button, and a first length along a first longitudinal axis that is greater than a first width of the case perpendicular to the first longitudinal axis, wherein the first longitudinal axis intersects the button; and a circuit board to which the first transceiver and the first processor are attached, the circuit board having a second length along a second longitudinal axis that is greater in magnitude than a second width of the circuit board perpendicular to the second longitudinal axis, wherein the second longitudinal axis intersects the button and is parallel to the first longitudinal axis; and a cradle configured to receive the wireless game control without regard to a rotational orientation of the wireless game control, and enable liquid spilt into the cradle to drain out of the cradle from a plurality of drainage openings.

17. The wireless wagering system of claim 16, further comprising:

the video wagering terminal, comprising:

a second transceiver configured to transmit the slave data packet to the first transceiver;

a second processor configured to:

determine whether the wireless game control is in the cradle;

generate information representing the activation status of the LED based on the determination of whether the wireless game control is in the cradle; and control transmission of the slave data packet in response to the second transceiver receiving a master data packet.

18. The wireless wagering system of claim 17, wherein the second processor is configured to generate the information in the slave data packet related to the communication channel to be used by the first transceiver.

19. A wireless wagering system, comprising:

a wireless game control, comprising:

a button configured to receive game-play input from a game player;

a first transceiver configured to communicate with a video wagering terminal;

a speaker configured to generate an alarm at a predetermined volume;

a processor configured to monitor a measure of the distance of the wireless game control from the video wagering terminal and control the speaker to sound the alarm in response to the measure indicating the wireless game control is beyond a predetermined distance from the video gaming terminal, wherein the first transceiver is configured to send a master data packet to a second transceiver of the video wagering terminal, and receive a slave data packet from the second transceiver in response to the second transceiver receiving the master data packet and wherein the processor is configured to determine the distance measure based on not receiving the slave data packet within a predetermined elapsed time after sending the master data packet;

a cradle configured to receive the wireless game control without regard to a rotational orientation of the wireless game control, and enable liquid spilt into the cradle to drain out of the cradle from a plurality of drainage openings;

a second transceiver configured to communicate with the wireless game control; and a power supply and battery charging circuit configured to supply power to the wireless game control and charge a battery of the wireless game control when the wireless game control is in the cradle.

20. The wireless wagering system of claim 19, wherein the first and second transceivers are configured to not successfully transmit master and slave data packets, respectively, beyond a predetermined distance.

21. The wireless wagering system of claim 20, wherein the predetermined distance is selected to represent the limit of the separation distance between the wireless game control and the video wagering terminal in which the wireless wagering system is functional to communicate game-play input from the wireless game control to the video wagering terminal.

* * * * *